United States Patent [19]

Jordan

[11] 4,020,792

[45] May 3, 1977

[54] SELECTIVE CORONA CHARGER

[75] Inventor: John Francis Jordan, El Paso, Tex.

[73] Assignee: Photon Power, Inc., Wilmington, Del.

[22] Filed: Mar. 22, 1976

[21] Appl. No.: 669,279

[52] U.S. Cl. ..... 118/629; 239/15; 361/228

[51] Int. Cl.[2] ..... B05B 5/02

[58] Field of Search ..... 118/56, 63, 300, 307, 118/325, 629, 630, 632, 634, 639; 239/15; 317/2, 3, 262

[56] References Cited

UNITED STATES PATENTS

| | | | |
|---|---|---|---|
| 593,896 | 11/1897 | Johnson | 118/325 X |
| 2,682,478 | 6/1954 | Howse | 118/629 X |
| 2,773,472 | 12/1956 | Lamm | 239/15 X |
| 3,866,571 | 2/1975 | Austin et al. | 118/629 X |
| 3,905,550 | 9/1975 | Rokadin et al. | 239/15 |

*Primary Examiner*—Louis K. Rimrodt
*Attorney, Agent, or Firm*—Kirkland & Ellis

[57] ABSTRACT

A selective corona charger is disclosed for imparting an electrical charge to liquid droplets in a spray, comprising conductor means, means for defining a grid, a means for moving the conductor means in the grid, scraper means for cleaning excess spray off the conductor means, and a power source for imparting a high voltage to the conductor means. The droplet charger is placed between the source of the spray and the article being sprayed. In operation, the article being sprayed is held at a low electrical potential, preferably ground. The spray is directed toward the article being sprayed and as the spray droplets pass through the corona charger they receive a high electrical potential or charge from the corona charger. The droplets are thereafter electrically attracted to the article being sprayed.

6 Claims, 3 Drawing Figures

SELECTIVE CORONA CHARGER

BACKGROUND OF THE INVENTION

1. Field of the Invention

The present invention relates to devices for electrically charging liquid droplets, and more particularly to devices for electrically charging selected liquid droplets in a spray utilized to coat an article with a soluble substance.

2. Description of The Prior Art

An expeditious way of providing an article with a coating of a substance is by spraying, as long as the substance is sufficiently soluble so that a liquid solution can be made for spraying purposes. However, spray processes can be inefficient when the spray particles are small and the spray process must be conducted in repeated passes or for relatively long periods of time. Under these conditions the capture rate of the spray, i.e. the amount of spray falling on the article being sprayed as opposed to the amount carried away by exhaust fumes or falling on the surrounding spray apparatus, can be 10% or less. A very low capture efficiency increases the cost of spray processes. Where expensive solutions are utilized, the expense associated with a loss of up to 90% of the solution being sprayed can be prohibitive.

Prior art solutions to this problem include one method whereby a high voltage electrical charge is placed on the spray nozzle. The article being sprayed is held at a lower electrical potential, such as ground. As the liquid droplets emerge from the spray nozzle, each droplet becomes charged with a high voltage, thereby becoming electrically attractive to the article being sprayed. This method increases capture efficiency, and therefore decreases the cost, of the spraying process.

However, some spray processes must be conducted at elevated temperatures or in a specialized environment, such as oxygen free atmosphere, etc. Economic feasibility dictates that these spray processes be conducted in spray booths which are not significantly larger than necessary to contain the spray apparatus and the article being sprayed. The charged droplets, however, are attracted to any proximate material at a lower or ground potential, not just the article desired to be coated. Since safety considerations generally preclude maintaining the entire spray booth and associated spray apparatus at the same high electrical potential as the spray nozzle, the spray booth, as well as the article being sprayed, attract the charged spray particles and become coated with the solution.

Under certain circumstances, the excess coating which lines the interior of the spray booth can be periodically washed or scraped down and recovered for reuse. However, even minor accumulation of the coating within the spray booth may cause dust and debris to fall from the surface of the spray booth onto the article being sprayed, thereby ruining the spray coating.

Moreover, if the solution being sprayed is electrically conductive, the supply lines and solution must either be at the same high potential as the high voltage spray nozzle, or an elaborate means for insulating or isolating the solution must be utilized. This can be very difficult and expensive to accomplish.

The present invention overcomes each of these problems. The liquid droplets are selectively charged, i.e. only those reaching close proximity to the article being sprayed are charged. Therefore, only the article being sprayed and the apparatus immediately adjacent to it become coated. The capture efficiency is increased, but the problems of the prior art devices are overcome.

SUMMARY OF THE INVENTION

An apparatus for electrically charging liquid droplets in accordance with the present invention comprises an electrical conductor means, means for defining a grid comprised of the conductor means, means for moving the conductor means within the grid, scraper means, and an electrical power source in electrical contact with the conductor means. The conductor means may take the form of a metal wire. The means for defining a grid may comprise a plurality of pulleys mounted on a mounting means, which may comprise a rigid frame having an aperture therein.

The scraper means may comprise a plurality of fiberous filaments in surface contact with the conductor means.

The means for moving the conductor means may comprise an electric motor in mechanical contact with the conductor means.

It is a primary object of the present invention to increase the capture efficiency of liquid droplet sprays directed at articles to be coated.

Another object of the present invention is to provide a novel means for imparting an electrical charge to selected liquid droplets in a spray.

Yet a further object of the present invention is to improve the quality of a coating imparted on an article by means of a liquid droplet spray process.

These and other objects, advantages, and features of the subject invention will hereinafter appear, and for the purposes of illustration, but not of limitation, an exemplary embodiment of the present invention is illustrated in the accompanying drawings.

DETAILED DESCRIPTION

Figure 1:
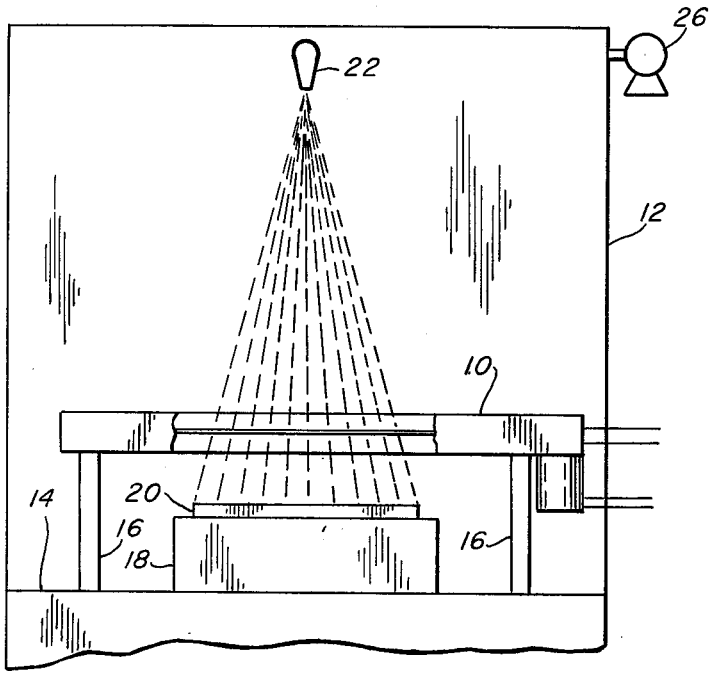
FIG. 1 is a side, partially fragmentary view of the preferred embodiment of a selective corona charger according to the present invention.

With respect to FIG. 1, a preferred embodiment of a selective corona charger 10 according to the present invention is shown in place within spray booth 12. Corona charger 10 is elevated from the floor 14 of spray booth 12 by suitable insulated support members 16. Work piece 20 is positioned on support station 18, which may take the form of a conveyer belt, a float tank, or other means appropriate to the particular spray process involved. Corona charger 10 is positioned between work piece 20 and spray nozzle 22. Of course, a plurality of spray nozzles or other spray generating devices may be used, as well as different orientations of the work piece 20, spray nozzle 22, and droplet charger 10, so long as corona charger 10 is positioned between work piece 20 and spray nozzle 22. Exhaust pump 26 is provided to withdraw the air and excess spray from within spray booth 12. Suitable scrubbers or other reclamation means may be provided to extract valuable chemicals from this excess spray.

Figure 2:
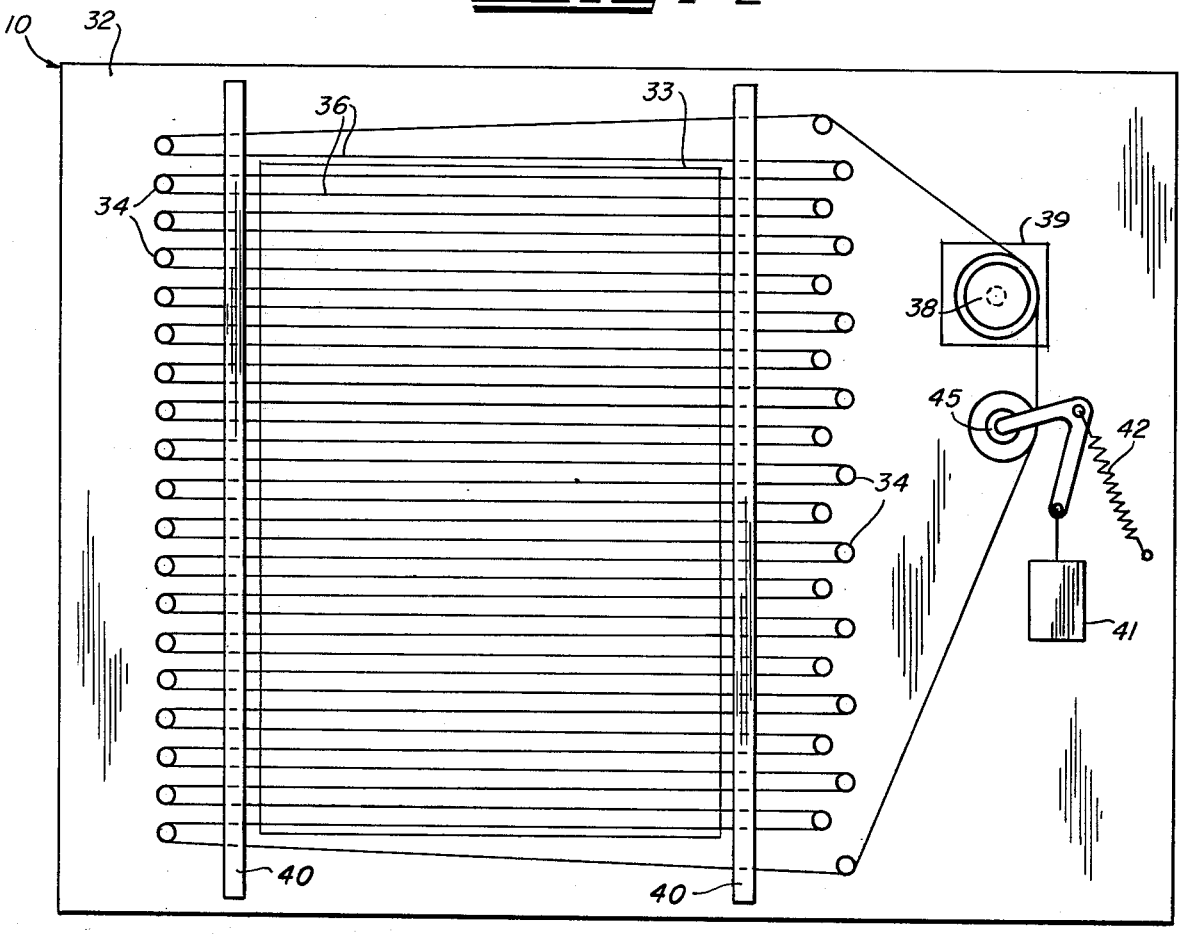
FIG. 2 is a bottom view of the selective corona charger illustrated in FIG. 1.

As shown in FIG. 2, corona charger 10 has frame 32. Insulated pulleys 34 are positioned on either side of aperture 33 in frame 32 and define a grid. Conductor wire 36 is stretched around pulleys 34 and insulated drive pulley 38, which is connected to a suitable drive means, such as electric motor 39, for forcing the conductor wire 36 to move in a path around pulleys 34. Tension in conductor wire 36 is maintained by idler pulley 45, which is connected to suitable spring means 42. Idler pulley 34 is constructed of conductive material and is electrically connected with power source 41.

In operation, idler pulley 45 imparts a high voltage, low current charge on conductor wire 36 via electrical contact therewith. Conductor wire 36 is moved constantly around insulated pulleys 34 by operation of drive pulley 38. Because the high voltage on the conductor wire 36 is provided by idler pulley 45 and because drive pulley 38 is insulated, the drive means for drive pulley 38 can be a normal electric motor, such as motor 39 and no special mechanisms or insulators are required.

The voltage imparted on conductor wire 36 is chosen so that, given the physical and electrical characteristics of conductor wire 36 and the spacing and dimensions of insulated pulleys 34, a corona effect will be generated.

As liquid droplets of a spray pass through aperture 33, an electrical charge is imparted thereto by the corona generated by conductor wire 36. The work piece is maintained at an electrical potential less than the voltage imparted to conductor wire 36, preferably ground potential. Thus, the charged liqud droplets are electrically attracted to the work piece.

Some of the liquid droplets of the spray fall on and adhere to conductor wire 36. If allowed to build up unabated, large droplets of the solution being sprayed may fall off conductor wire 36 onto work piece 20, ruining the coating being sprayed thereon. Consequently, scrapers 40 are provided to continuously clean each strand of conductor wire 36 to prevent solution build up.

Figure 3:
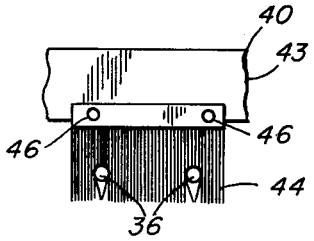
FIG. 3 is an enlarged side view of the scraper portion of the selective corona charger illustrated in FIGS. 1 and 2.

As depicted in FIG. 3, the preferred embodiment of scrapers 40 takes on the form of support channel 43, to which is affixed filaments 44 by means of fasteners 46. Filaments 44 are in surface contact with conductor wire 36, and scrape excess solution and debris off the surface thereof. Scrapers 40 are positioned on frame 32 such that they are not over work piece 20. Consequently, any solution or debris falling from filaments 44 of scraper 40 will not fall on work piece 20. Other means for removing excess solution and debris from the conductor wire may be substituted for scrapers 40, such as an electrostatic cleaner.

The selective corona charger according to the present invention may be oriented differently than the preferred embodiment, such as to accommodate spray coating on article while vertically disposed. Similarly, other geometric configurations of the apparatus or conductor wire may be utilized. Therefore, it should be understood that various changes, modifications, and variations in the structure and function of the present invention may be effected without departing from the spirit and scope of the present invention as defined in the appended claims.

What is claimed:

1. An apparatus for coating a workpiece with a compound, said apparatus being of the type comprising a droplet generator for generating droplets and a charging means for electrically charging said droplets, in the operation of which said droplets receive a charge from said charging means before impining said workpiece, wherein said charging means comprises:
   - an electrical conductor means;
   - means for defining a grid comprised of said conductor means;
   - means for moving said conductor means within said grid;
   - scraper means for removing excess compound impinging on said conductor means; and
   - an electrical power source in electrical contact with said conductor means;
   - the physical characteristics of said grid and said electrical power source being chosen so as to generate a corona effect within the area surrounding said conductor means.

2. An apparatus as claimed in claim 1, wherein the means for defining a grid comprises a plurality of pulleys and a mounting means for mounting said pulleys.

3. An apparatus as claimed in claim 1, wherein the scraper means comprise a plurality of fiberous filaments in surface contact with said conductor means.

4. An apparatus as claimed in claim 1, wherein the conductor means is a metal wire.

5. An apparatus as claimed in claim 4, wherein the means for moving said conductor means comprises an electrical motor in mechanical contact with said conductor means.

6. An apparatus for coating an article with a compound capable of dissolving or being suspended in a solution, said apparatus being of the type comprising a droplet generator for generating droplets and a charging means for electrically charging said droplets, in the operation of which said droplets are charged by said charging means before impinging said workpiece, wherein said charging means comprises:
   - a plurality of pulleys;
   - a mounting means for mounting said pulleys in a grid defining orientation;
   - an electrically conductive wire passing around said pulleys;
   - a drive means in mechanical contact with at least one of said pulleys and adapted to impart circular motion in at least one of the pulleys it is in contact with;
   - a plurality of fibrous filaments in surface contact with at least a portion of said wire;
   - an electrical power source in electrical contact with said wire;
   - said wire, said pulleys, and said power source being adapted so as to generate an electrical corona over at least a portion of a planar area through which said droplets pass.

* * * * *